US006669153B1

(12) United States Patent
Allan

(10) Patent No.: US 6,669,153 B1
(45) Date of Patent: Dec. 30, 2003

(54) FURNITURE FOOT

(76) Inventor: Christopher John Allan, 2 Juba Ct., Mulgrave, VIC (AU), 3170

( * ) Notice: Subject to any disclaimer, the term of this patent is extended or adjusted under 35 U.S.C. 154(b) by 0 days.

(21) Appl. No.: 09/831,760

(22) PCT Filed: Nov. 17, 1999

(86) PCT No.: PCT/AU99/01009

§ 371 (c)(1),
(2), (4) Date: Jun. 29, 2001

(87) PCT Pub. No.: WO00/28860

PCT Pub. Date: May 25, 2000

(30) Foreign Application Priority Data

Nov. 17, 1998 (AU) ..... PP7143

(51) Int. Cl.[7] ..... A47B 91/00
(52) U.S. Cl. ..... 248/188.9; 248/346.11
(58) Field of Search ..... 248/188.8, 188.9, 248/346.11, 688, 677, 615

(56) References Cited

U.S. PATENT DOCUMENTS

| | | | | | |
|---|---|---|---|---|---|
| 1,915,272 | A | * | 6/1933 | Duncan, Jr. | 248/188.9 |
| 2,135,945 | A | * | 11/1938 | Miller | 16/42 |
| 2,875,552 | A | | 3/1959 | Stillman | |
| 2,921,760 | A | * | 1/1960 | Wheller | 248/615 |
| 3,455,526 | A | * | 7/1969 | Orii | 248/615 |
| 3,646,633 | A | * | 3/1972 | Meinhardt | 16/42 R |
| 3,970,273 | A | * | 7/1976 | Tanner | 248/615 |
| 4,798,359 | A | * | 1/1989 | Ball | 248/188.3 |

FOREIGN PATENT DOCUMENTS

| | | |
|---|---|---|
| AU | 19417 | 9/1910 |
| AU | 264000 | 12/1965 |
| EP | 99957732 | 6/2003 |
| GB | 433838 | 5/1934 |
| GB | 1621634 | 5/1934 |
| GB | 942276 | 3/1962 |
| GB | 984601 | 11/1963 |
| GB | 1463707 | 11/1975 |
| GB | 4436874 | 11/1975 |

* cited by examiner

*Primary Examiner*—Ramon O. Ramirez
*Assistant Examiner*—Kofi Schulterbrandt
(74) *Attorney, Agent, or Firm*—Volpe and Koenig, P.C.

(57) ABSTRACT

A foot device for use with furniture which device includes a rigid portion having a body with a first face which contacts the furniture and a second face which is directed towards a floor with low slip material protruding from at least one recess in the second face.

5 Claims, 1 Drawing Sheet

FURNITURE FOOT

TECHNICAL AREA

This invention relates to the area of furniture and in particular to improvements in feet that are found on many types of furniture.

BACKGROUND TO THE INVENTION

On many types of flooring including tiles, floor boards, parquetry floors, cork floors and slate floors it is well known that existing furniture feet are prone to slide. This can result in scratching or scuffing of the floor and may also be unsafe for the furniture user as the furniture may slide from under them.

An aesthetic problem also arises with furniture items which are meant to be configured in a certain manner but in practice slide apart leaving gaps between them.

There exist a range of such feet which permit easy manoeuvrability of furniture over such surfaces but none provide the ability to maintain the furniture item in position once located.

OUTLINE OF THE INVENTION

It is an object of this invention to provide a furniture foot which maintains furniture in a required position and minimises any damage to an underlying floor.

The invention is a foot device for use with furniture which device includes a rigid portion having a body with a first face which contacts the furniture and a second face which is directed towards a floor with low slip material protruding from at least one recess in the second face.

Preferably the resilient material is located in an annular groove which is concentric with the mid point of the foot device body.

It is also preferred that where ease of furniture movement is desired the second face is provided with a curved outer periphery and at least one recess through which means for connecting to the furniture may pass.

It is further preferred that, where the foot device is required to support in situ furniture legs or supports, a recess be provided in the first face to accommodate said legs or supports.

In order that the invention may be more readily understood we shall describe by way of non limiting example two specific embodiments thereof, in relation to the accompanying drawings.

BRIEF DESCRIPTION OF THE DRAWINGS FIGURES

Figure 1:
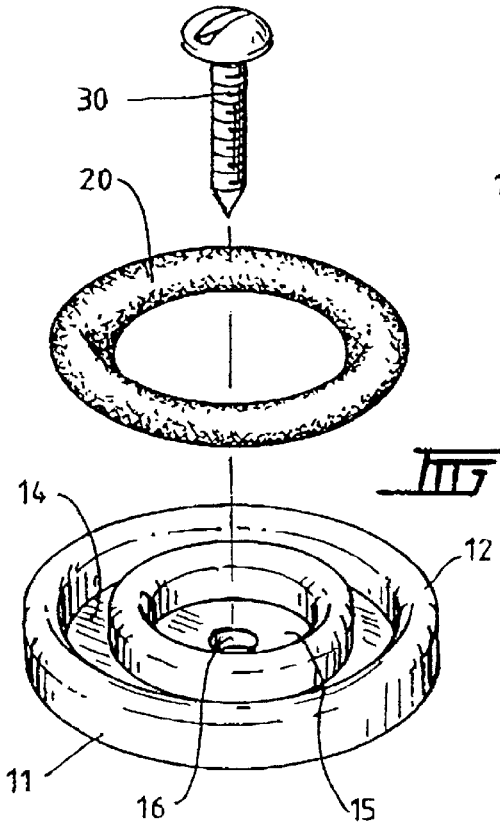
FIG. 1 shows the components of a first embodiment of the invention.
Figure 2:
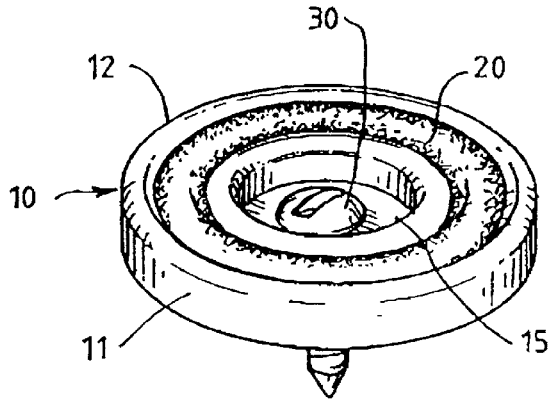
FIG. 2 shows the components of FIG. 1 assembled.

In a first embodiment of the invention shown in FIGS. 1 and 2 the foot device 10 has a body member 11 made, preferably by injection moulding, of a hard polypropylene plastic with a face having a recess 14 into which a ring 20 of a low slip material such as Santoprene, which has a high coefficient of friction when placed on a floor, can fit. The arrangement is such that the ring protrudes from recess 14 so that when the furniture item is standing upright the ring 20 provides a good grip on the floor surface.

Figure 3:
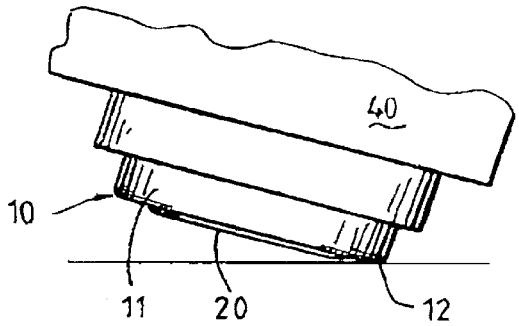
FIG. 3 shows the above embodiment of the invention located on the furniture and angled for movement.

This face is also provided with a curved periphery 12 so that tilting the furniture item 40 as shown in FIG. 3 causes the ring 20 to cease contacting the floor and the furniture item can slide on the curved periphery 12. The foot device is attached to the furniture item 40 by a screw 30 passing through an aperture 16 in recess 15.

The body shape may be of any shape or height desired although it is envisaged that it will most likely be circular or rectangular.

The ring material and body material likewise may be of any desired material however it is envisaged that the body be made of a hard plastic which has good dimensional stability and would slide well over a floor while the ring which can be of a soft material has good gripping qualities. Because the major portion of the ring is in the recess 14 deformation of this is restricted.

Figure 5:
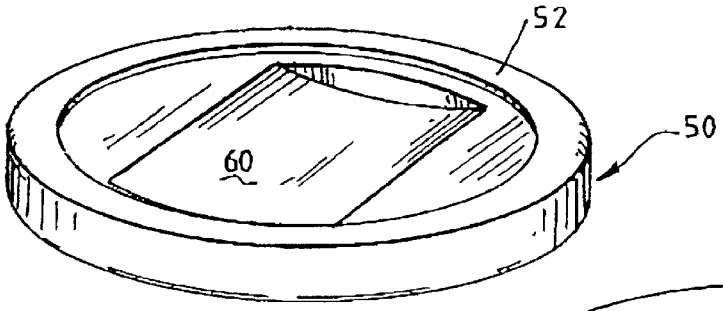
FIG. 5 is a perspective view of the first face of the embodiment shown in FIG. 4.
Figure 4:
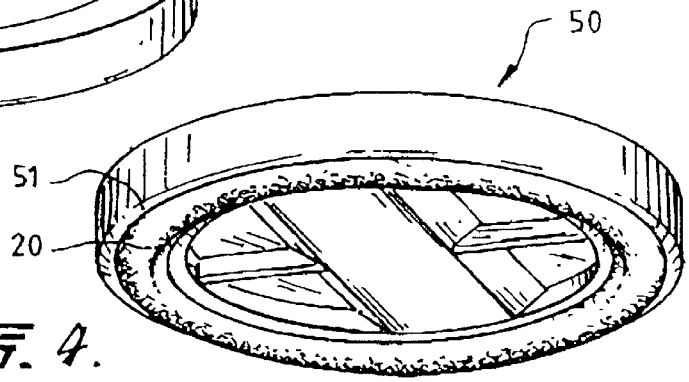
FIG. 4 shows a plan view of the second face of a second embodiment of the invention.

In another embodiment of the invention 50 the foot device can stand alone and be used to support existing furniture legs or other devices such as castors fitted thereto. In the example shown in FIGS. 4 and 5 a face 51 incorporating the grip ring 20 is provided to contact the floor while the opposing face 52 of the device is provided with an excised portion 60 capable of holding a wheel device in situ when such a castor or the like is attached to a furniture item.

This arrangement permits a wheel mounted item of furniture to be held in a given position with the additional benefit of not marking the floor. It is envisaged that the shape of the excised portion 60 may be varied to fit any particular furniture mount or to directly receive a leg of a piece of furniture being supported by the device.

Whilst we have described herein two specific embodiments of the invention it is envisaged that other embodiments of the invention will exhibit any number of and any combination of the features previously described and it is to be understood that variations and modifications in this can be made without departing from the spirit and scope of the invention.

What is claimed is:

1. A foot device for use with furniture which device includes a rigid portion molded as a single integral component from a hard plastic material the rigid portion having upper centrally located face which is shaped so as to be in direct supporting abutment with a supporting portion of the furniture and a lower face which is directed towards a floor, with a unitary annular ring of soft low slip material slidable directly into an annular groove formed in the lower face to be retained within the annular groove, the unitary annular ring of soft low slip material protruding from the lower face to form an annular load bearing surface surrounding and leaving exposed a central portion of the hard plastic material forming the lower faces; the central portion being recessed to provide that only the load bearing surface comes into contact with the floor when the furniture is supported by the foot device in a rest position on the floor, the annular groove being concentric with the mid point of the rigid portion and being constructed such that a major portion of the unitary annular ring of soft low slip material is retained within the annular groove so as to restrict deformation of the unitary annular ring of soft low slip material when force is applied to the foot device, wherein the depth of the foot device is substantially less than the footprint the unitary annular ring of soft low slip material makes when it rests on the floor.

2. The foot device of claim 1, wherein the unitary annular ring of soft low slip material is surrounded by a hard annular ring comprising an outer part of the rigid portion the construction of the foot device being such that when the furniture to which the device is fitted is in the rest position, the unitary annular ring of soft low slip material is in contact with the floor and acts to prevent movement of the furniture, but when the furniture is to be moved, on tilting of the furniture the unitary annular ring of soft low slip material is moved from contact with the floor and part of the hard annular ring contacts the floor and presents a bearing surface to allow the furniture to readily be slid along the floor.

3. The foot device of claim 2, wherein the hard annular ring is curved to permit ready movement along the floor.

4. The floor device of claim 1, including an aperture in the exposed central portion for allowing the foot device to be fastened to the furniture by means of a screw passing therethrough.

5. The foot device of claim 1, wherein the upper face is provided with a recess adapted to receive and hold in position in the recess a mount for a furniture item.

* * * * *

UNITED STATES PATENT AND TRADEMARK OFFICE

CERTIFICATE OF CORRECTION

PATENT NO. : 6,669,153 B1
DATED : December 30, 2003
INVENTOR(S) : Christopher John Allan It is certified that error appears in the above-identified patent and that said Letters Patent is hereby corrected as shown below:

Column 2,
Line 48, after the word “having”, insert -- an --.
Line 58, after the word “lower”, delete “faces” and insert therefor -- face --.

Signed and Sealed this

Fifteenth Day of June, 2004

JON W. DUDAS
*Acting Director of the United States Patent and Trademark Office*